US006705128B1

(12) United States Patent
Sciacca

(10) Patent No.: US 6,705,128 B1
(45) Date of Patent: Mar. 16, 2004

(54) METHOD AND APPARATUS FOR MANUFACTURING THREE-DIMENSIONAL KNITWEAR AND HOSIERY ITEMS AND PRODUCTS OBTAINED THEREBY

(76) Inventor: Franco Sciacca, Via Veneto 18, I-22070 Cassina Rizzardi (IT)

( * ) Notice: Subject to any disclaimer, the term of this patent is extended or adjusted under 35 U.S.C. 154(b) by 444 days.

(21) Appl. No.: 09/869,732

(22) PCT Filed: Nov. 14, 2000

(86) PCT No.: PCT/IT00/00464

§ 371 (c)(1),
(2), (4) Date: Feb. 5, 2002

(87) PCT Pub. No.: WO01/36729

PCT Pub. Date: May 25, 2001

(30) Foreign Application Priority Data

Nov. 15, 1999 (IT) ..... CO99A0031

(51) Int. Cl.[7] ..... D04B 9/00
(52) U.S. Cl. ..... 66/17; 66/202
(58) Field of Search ..... 66/8, 9 R, 17, 66/19, 20, 25, 30, 51, 169 R, 170, 171, 172 R, 172 E, 189, 190, 202

(56) References Cited

U.S. PATENT DOCUMENTS 4,608,839 A * 9/1986 Tibbals, Jr. ..... 66/13
4,796,444 A * 1/1989 Tibbals, Jr. ..... 66/13
5,133,196 A * 7/1992 Tibbals, Jr. ..... 66/35
5,144,817 A * 9/1992 Tibbals, Jr. ..... 66/140 R
5,823,013 A * 10/1998 Lonati et al. ..... 66/177

FOREIGN PATENT DOCUMENTS

DE 2424834 * 1/1975
GB 1482471 * 8/1977

* cited by examiner

*Primary Examiner*—Danny Worrell
(74) *Attorney, Agent, or Firm*—James B. Conte; Barnes & Thornburg

(57) ABSTRACT

The invention relates to a method and apparatus for manufacturing three-dimensional tubular knitwear items, preferably provided with shoulder straps, neck portion and/or various openings for feet, legs or arms, manufactured without the usual expensive fabric scraps deriving from the cutting/sewing operations. By means of a suitable selection of needles, or thanks to a particular yarn which melts completely during finishing, according to the jacquard design or to the work cycle of the textile machine, the present invention enables the separation and/or the automatic programmed resumption of knitted courses according to specific zones or areas, thus obtaining at least one opening (5,5A) or shoulder strap, provided with a singe or double welt. The hosiery items are automatically closed on their ends, corresponding to the foot heel or toe, and provided with at least one opening with single or double welt.

36 Claims, 6 Drawing Sheets

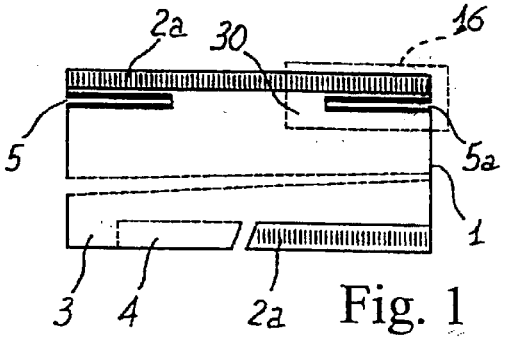
Fig. 1
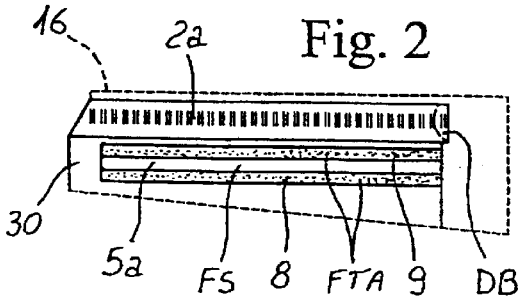
Fig. 2
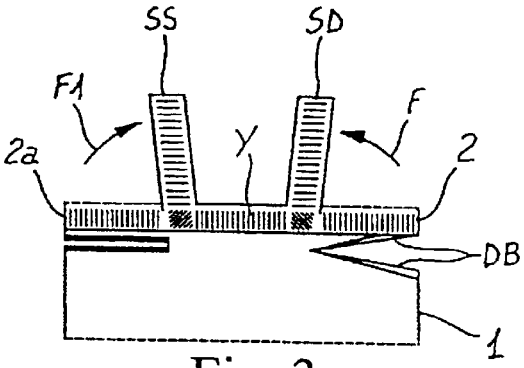
Fig. 3
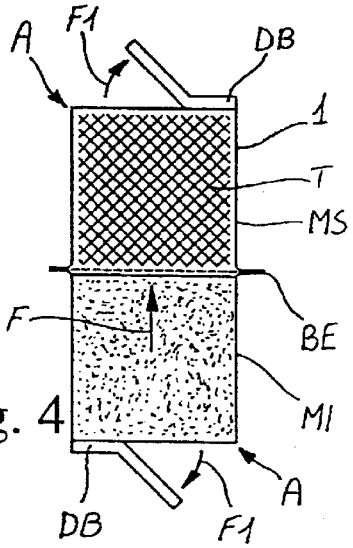
Fig. 4
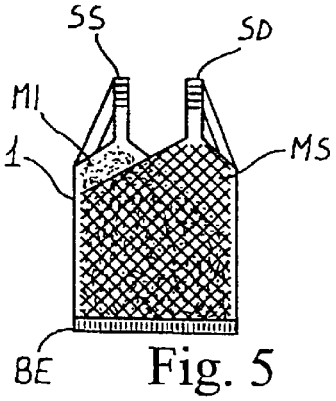
Fig. 5
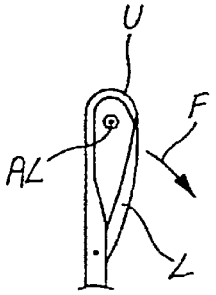
Fig. 6
Fig. 7
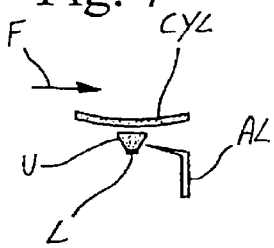
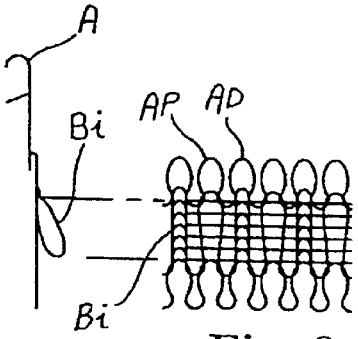
Fig. 8a
Fig. 8
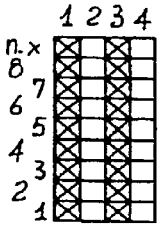
Fig. 9
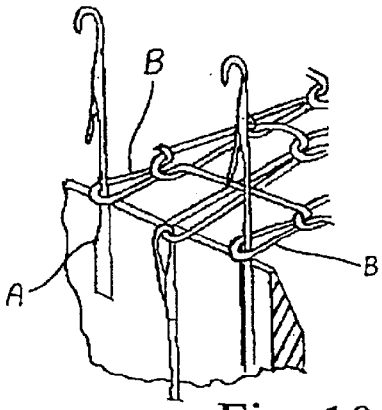
Fig. 10

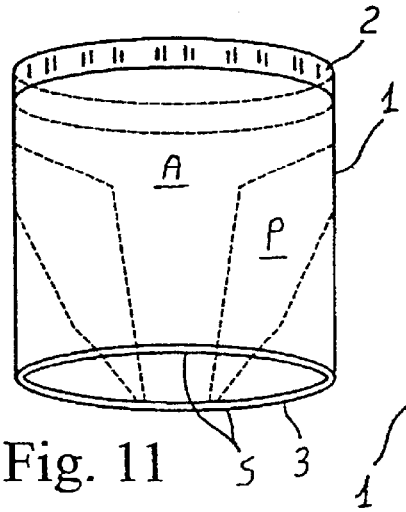
Fig. 11
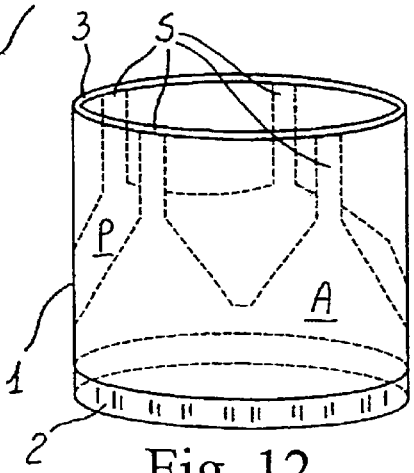
Fig. 12
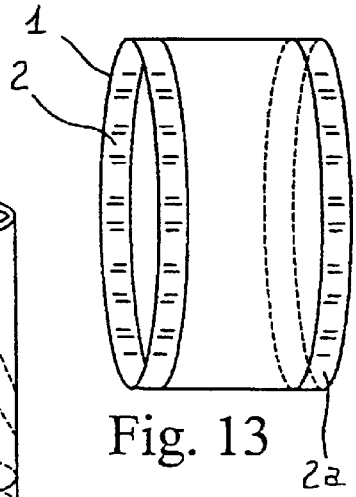
Fig. 13
Fig. 14
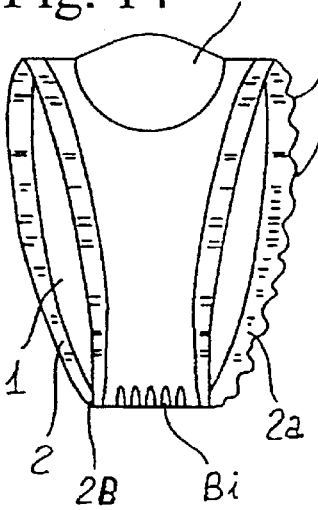
Fig. 16
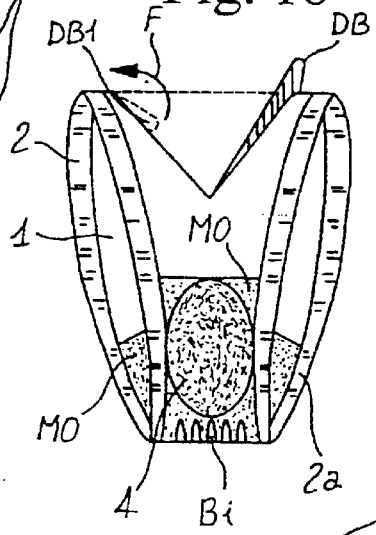
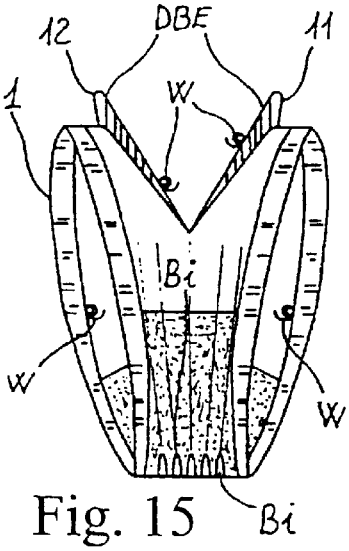
Fig. 15
Fig. 17
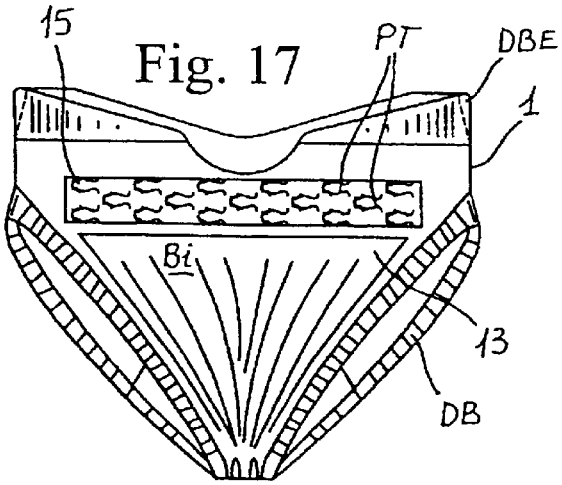
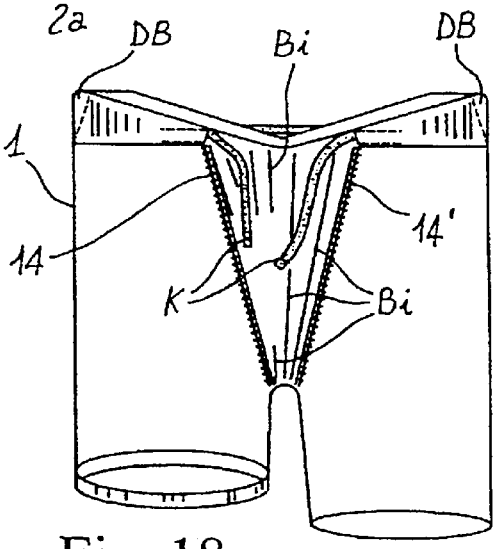
Fig. 18

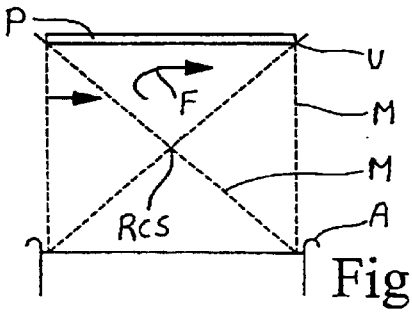
Fig. 25
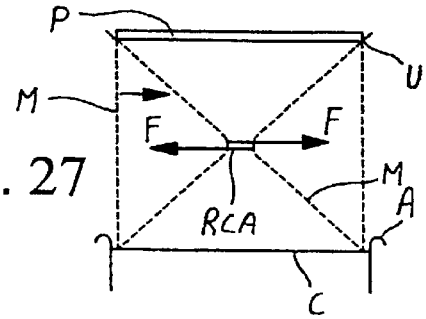
Fig. 27
Fig. 26
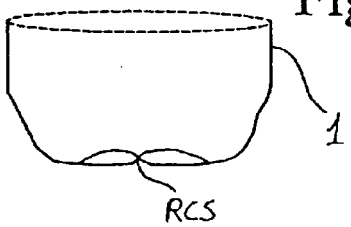
Fig. 28
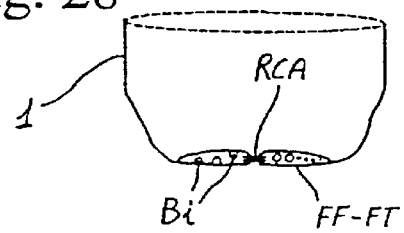
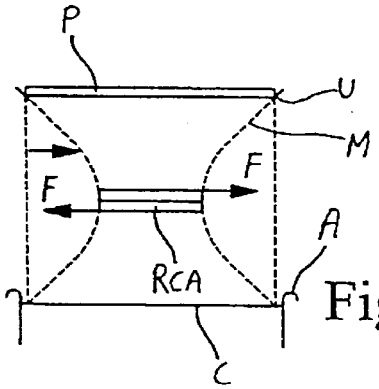
Fig. 29
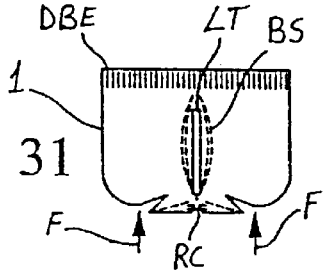
Fig. 31
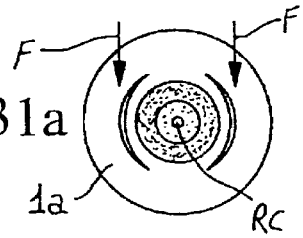
Fig. 31a
Fig. 30
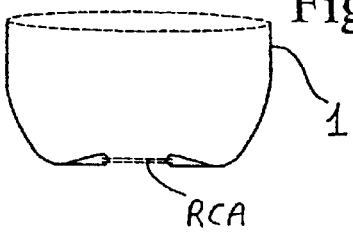
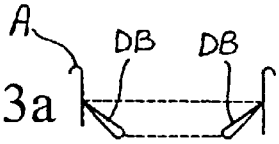
Fig. 33a
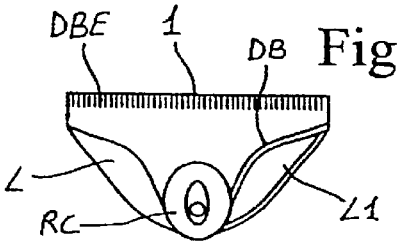
Fig. 32
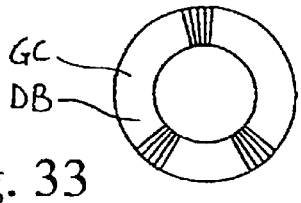
Fig. 33

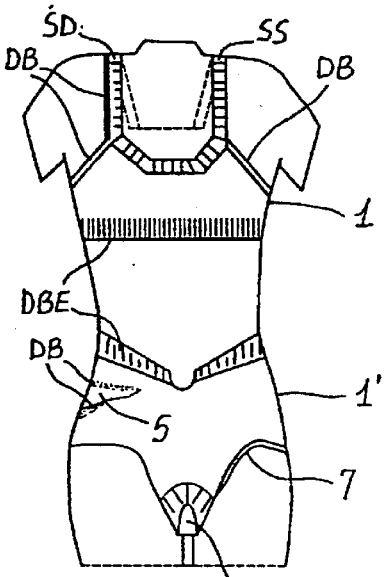
Fig. 34
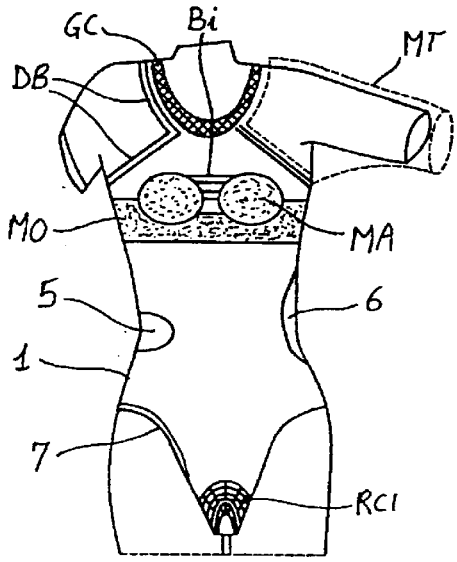
Fig. 35
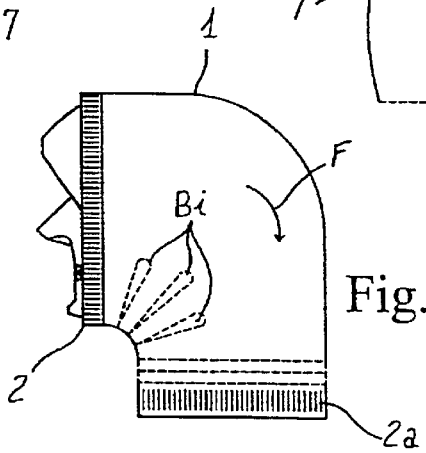
Fig. 39
Fig. 37
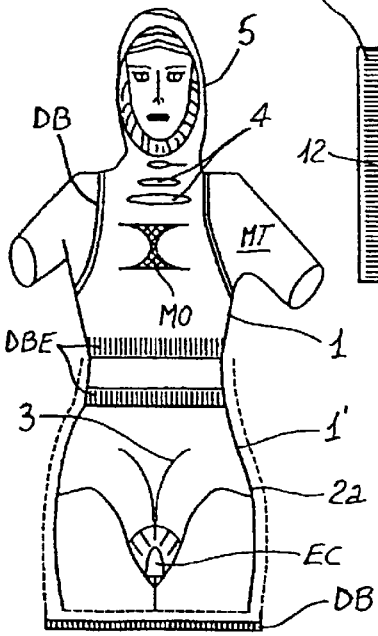
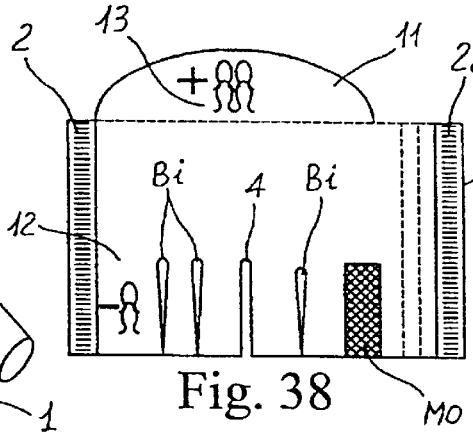
Fig. 38
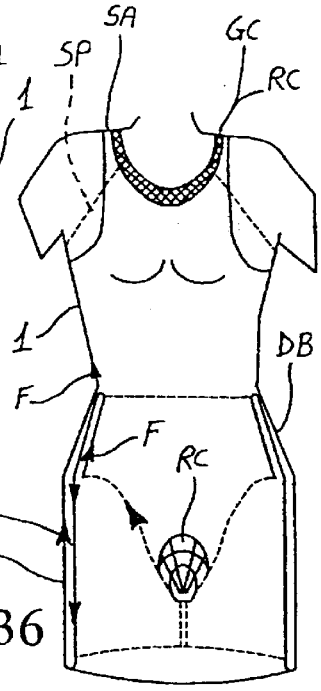
Fig. 36

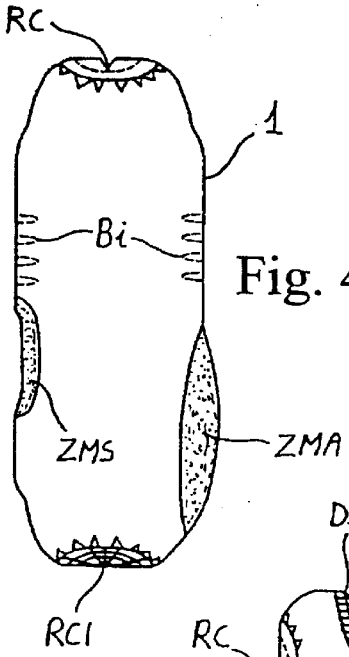
Fig. 40
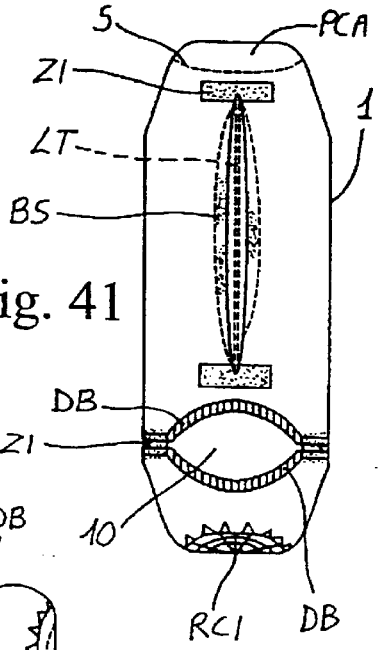
Fig. 41
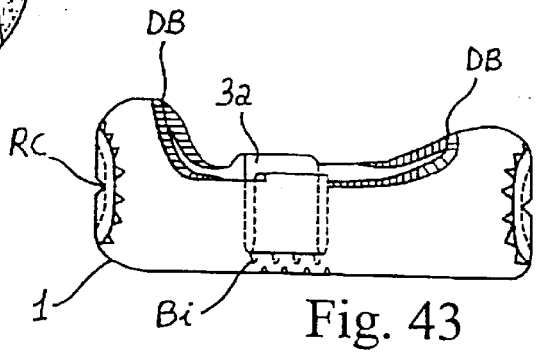
Fig. 43
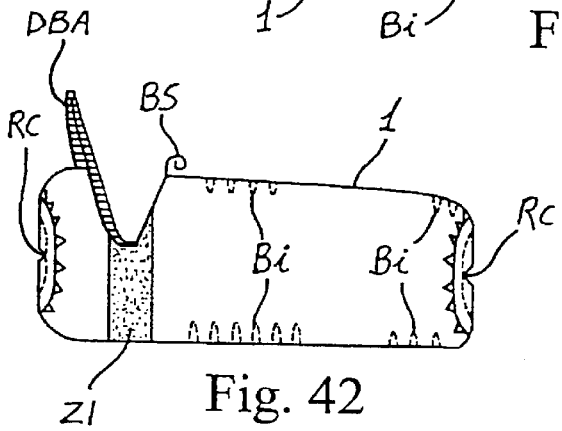
Fig. 42
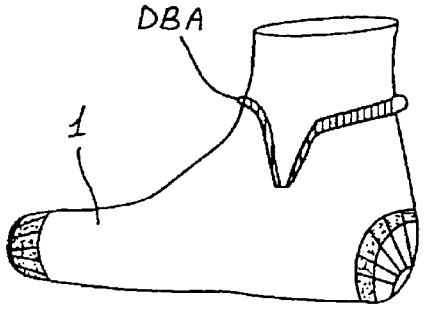
Fig. 44
Fig. 45
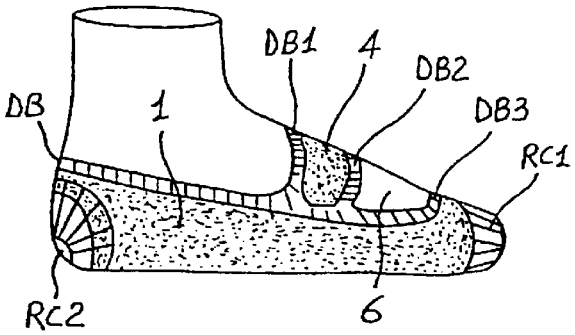
Fig. 46
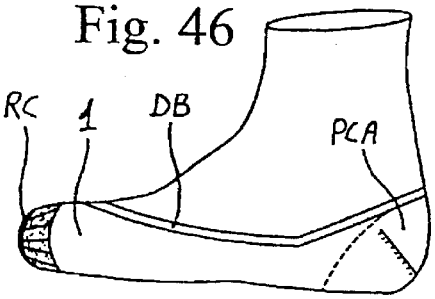

METHOD AND APPARATUS FOR MANUFACTURING THREE-DIMENSIONAL KNITWEAR AND HOSIERY ITEMS AND PRODUCTS OBTAINED THEREBY

TECHNICAL FIELD

The present invention relates to a method and apparatus for manufacturing three-dimensional knitwear and hosiery items and products obtained thereby.

The recent introduction of "full electronic" circular knitting machines with differentiated diameters has attracted the knitting industry's interest since the versatility of these machines allows to produce a wide range of knitwear and hosiery items, such as for instance bras, pants, dresses, trousers, skirts, teddies, swimsuits, technical items, and more.

But due to some inherent technical limitations, such as for instance the lack of shoulder straps, loops and openings for feet, legs and arms, most of the aforementioned knitwear items systematically require laborious and expensive additional finishing operations such as cutting and/or sewing, with a high amount of fabric scraps which affect production costs extensively and permanently.

AIMS OF THE INVENTION

The present invention aims at reducing to a significant extent or eliminate the aforesaid technical and productive limitations, so as to automatically manufacture said knitwear items provided with shoulder straps and/or various openings, preferably without fabric scraps, with original economical, technical, aesthetic and commercial purposes.

Consequently, a main aim of the present invention consists in providing a method and its apparatus for manufacturing tubular knitwear items in general, with three-dimensional and shaped effects, provided with at least one shoulder strap, or loop and various openings.

An additional aim consists in providing a method and apparatus for manufacturing knitwear items such as for instance bras, pants, underwear and woolens, skirts, trousers, stockings, stocking-soles and knitted technical items in general, practically obtained with no fabric scraps.

A further main aim consists in providing a method and apparatus for manufacturing tubular knitwear items whose shoulder straps or openings are provided with single or double welts, produced both with the dial and with the suitably chosen needles.

Another aim consists in providing a method and apparatus for manufacturing tubular knitwear items provided with shoulder straps and various openings with single or double welts, produced by suitably using a particular thermo-soluble yarn, which can melt completely during the following production stages, typically dyeing, boarding and finishing.

An additional aim consists in providing a method for manufacturing tubular knitwear items provided at least with shoulder straps or openings on which sleeves, stockings or trousers, preferably tubular with cuffs or welts, are sewn successively.

A final aim consists in providing a method and apparatus for manufacturing also two-layer or concentric tubular knitwear items.

DISCLOSURE OF THE INVENTION

The above mentioned aims are substantially achieved by a method and an apparatus for manufacturing three-dimensional knitwear and hosiery items according to the appended claims.

Further aims result from the description, examples and enclosed drawings, per se or in combination one with the other, together with the final claims.

The features of the invention and the advantages deriving thereof are more evident thanks to the following non limiting description of embodiments provided by way of examples, and advantageously apply to most of circular knitting machines for knitwear and hosiery.

BRIEF DESCRIPTION OF THE DRAWINGS

The description will be made with reference to the accompanying drawings in which:

FIG. 1 shows a tubular knitted fabric or item 1 with two openings 5A;

FIG. 2 is an enlarged view of an aperture 5a of the fabric of FIG. 1;

FIG. 3 shows the knitted tube of FIG. 1 with a pair of shoulder straps obtained therein according to the present invention;

FIGS. 4 and 5 show the progressive transformation of a knit tube into a particular two-fabric manufactured item;

FIG. 6 is an enlarged view of a latch needle with an latch-opening device AL;

FIG. 7 shows schematically a plan view of a latch-opening device AL in a knitting machine in accordance with the present invention;

FIGS. 8, 8*a* and 9 technically show the sequences for the production of the three-dimensional knit frills Bi;

FIG. 10 is a perspective view of the needles carrying out the sequences for the production of knit frills Bi;

FIG. 11 shows a tubular knitted fabric in which a panty to be cut and sewn is defined by dashed lines;

FIG. 12 shows a tubular knitted fabric in which an undershirt to be cut and sewn is defined by dashed lines;

FIG. 13 shows a tubular fabric 1;

FIGS. 14 to 18 show different embodiments of pants provided with complete lateral openings for legs and upper openings obtained from a knitted tube 1 with a method according to the present invention;

FIG. 25 schematically shows a method for totally or partially closing at least one end of a knitted tube by narrowing or centrally twisting said tube according to the present invention;

FIG. 26 shows the knitted tube 1 obtained with the method of FIG. 25;

FIG. 27 schematically shows another embodiment of a method for totally or partially closing at least one end of a knitted tube according to the present invention;

FIG. 28 shows the knitted tube 1 obtained with the method of FIG. 27;

FIG. 29 schematically shows an alternative embodiment of the method of FIG. 27;

FIG. 30 shows the knitted tube 1 obtained with the method of FIG. 29;

FIGS. 31, 31*a*, 32, 33 and 33*a* show different embodiments of knitwear items having a two-layer or two-fabric central rosette obtained according to one of the methods in FIGS. 25, 27 or 29;

FIGS. 34 to 37 show some practical embodiments of bras and pants carried out according to the invention;

FIGS. 38 and 39 show a shaped knitted hood indicated with the numeral 5 in FIG. 37;

FIGS. 40 to 46 show various embodiments of stockings provided with opening, loops, and two closed ends realized according to the present invention.

DESCRIPTION OF THE ILLUSTRATIVE EMBODIMENTS

Figure 19:
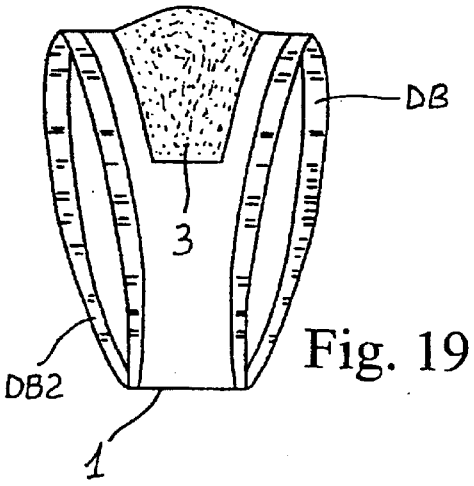
FIG. 19 shows a knitted tube 1 with an area 3 with wider stitches with respect to the adjacent areas.

Most of the description relates to a substantially circular machine equipped at least with: a needle bed and/or rotary cylinder versus fixed cams or vice versa; a complete working feed, therefore provided with one or more moving yarn feeders; preferably electronic needle selection in order to control the elements contributing to the fabric-building process according to a work cycle or jacquard design; a pneumatic or mechanic fabric-drawing system, and finally said circular machine is also equipped with a dial provided with selectable needles or jacks.

For some embodiments the present invention refers back also to the teachings of the Italian patents belonging to the same owner no. 1288310 and no. 1295743, together with patent no. 1255008, schematically shown in FIGS. 8–9–10.

In short, this latter patent relates to the production of two-layer or double-welt fabric, produced with a reduced number of needles A, preferably alternated, FIG. 10.

Even needles AP are temporarily excluded from the fabric-building process, and the simultaneous presence of working odd needles AD, alternated with the excluded even needles AP, in definite zones and for a relatively long time (sometimes corresponding to a high number of knitted courses) is the necessary condition for the production of a frill Bi, of closed or open fabric with two layers or fabric within the usual knitted tube, FIGS. 8, 8*a*. The fabric growth or inner frill Bi on the reverse of the fabric, said frill being repeatable and adjustable both in height and width and diagonally placed, corresponds on the right side of said fabric to a perfect stitch suture caused by the extension of the loops of the needles excluded from the production stage.

FIGS. 9 and 10 technically show how the above-mentioned fabric structure Bi can be carried out.

The presence of said frills Bi, with different designs and locations, affects substantially the production of some tubular knitwear items according to the present invention.

At present, most tubular knitwear items are obtained by means of slow and expensive working processes with alternated motion, such as for some stockings or stocking soles, or completed by means of complicated cutting operations along pre-established lines, and/or assembled by means of difficult sewing operations. For instance, in FIGS. 11 and 12 the knitted tube 1, provided with a double welt 2, is usually cut along the hatched guiding lines so as to distinguish front portion A from back portion P, and to sew together the resulting strips S on the ends 3. Said operations inevitably take a long time and cause a high amount of scraps which, though varying according to sizes and/or models, is often over 20% of the initial fabric, thus constituting a constant waste relevantly affecting the final cost of the products.

The invention is first carried out by preparing a work cycle and/or jacquard design, i.e. information to needles and/or jacks and/or other elements directly or indirectly involved in the fabric-building process, by means of the usual graphic workstation and/or control and/or memory devices or other usual means being suitable to said purpose. Therefore, the knitted tube 1 of FIG. 1 begins from the double welt 2A (3 and 4 indicate single and double welts without elastic) with a continuous selection of alternated needles, for instance the odd ones, or thanks to the jacks U of the dial P in FIGS. 25–27–29.

After completing the above-mentioned double welt 2A by means of the transfer of the dial hooks (and/or the stitch suture using the previously excluded needles, for instance the even ones), the fabric-building process goes on in zone 30, characterized by knitting structure whose function is to improve the non-run feature of the fabric.

The automatic release or discharge of the loops B, FIG. 10, carried out by the needles along lines or openings 5–5A in FIGS. 1 and 2, is preferably preceded by a preparatory stage with the possible automatic variation of the fabric thickness, together with the use of suitable additional yarns, also elastomeric or thermo-adhesive yarns, the latter being subject to partial melting and interlacing with the adjacent loops during the following hot-finishing stage. The release or discharge operation of the single loops or stitches carried out by a part of the needles can occur on the basis of several technical or textile needs or factors.

In a preferred embodiment, by setting the machine and/or the work cycle to the "zero" position, all the feeds are cancelled. During this stage the jacks U of the needles, FIG. 6, on which the last loops are placed, are preferably under the stitch formation line of the sinker.

After this preparatory stage only the programmed needles, typically grouped and in adjacent position, are sent to a rising cam without yarn so as to rise completely. The maximum elevation of said needles results in two important situations: all the latches L of the needles automatically open and place themselves beyond the last loops B, FIG. 10.

The following descent stage of said needles causes the automatic closing of the latches (L, FIG. 10) and the discharge or progressive distancing of the loops B from the concerned needles, thus producing a continuous horizontal opening in the direction of the courses within the knitted tube. Therefore, the knitted tube is now linked only with a part of the cylinder needles, whereas the remaining free needles, i.e. temporarily free of fabric, have to re-start the production process.

According to the invention said needles are therefore selected and progressively directed again onto at least one rising cam according to a pre-established sequence, such as for instance 1:3 (one working needle and three excluded needles) or 1:1 and the like, till the gradual rise of all the needles taking up a new yarn.

During the rise the needles having the latches L still closed, meet on their forced path a moving latch-opening device AL which opens said latches.

The described procedure is schematically shown in FIG. 6: the latch L is still against the hook U within which a metallic latch-opening tip AL is automatically positioned until the latch L is opened and folded in the direction of the arrow F. FIG. 7 shows a plan view of a portion of the cylinder CYL rotating according to the direction of the arrow F.

The hook U of the needle, against which the latch L adheres, meets on the forced rising path the latch opening element AL suitably introduced. The fabric-building process starts again with a single or double welt, i.e. single or double fabric, or according to the item to be manufactured, after the intervention of the mechanical and pneumatic latch-opening elements (in other embodiments the latch is opened by means of a suitable puff of compressed air coming from above, or through a thin plate to be inserted between the jack and the latch. The latch-opening element is not necessary for the so-called compound needles).

The planned interruption of the fabric-building process by a part of the cylinder needles according to defined fabric zones or areas, followed by the automatic and planned resumption of the fabric-building process preferably carried out by the same needles and/or defined fabric areas, causes the controlled separation of at least a part of two theoretically subsequent knitted courses, in turn characterized in that the first represents the last course of the fabric already produced, whereas the second represents the first knitted course preferably carried out by the same needles after the aforesaid interruption.

To the purposes of the present invention only a part of the needles located within the cylinder is destined to the release or discharge of the corresponding last loops or stitches.

Following the preset working cycle and/or jacquard design, in fact, the needles are programmed so as to operate in groups, i.e. a variable plurality of adjacent needles with a direct relation to the width of the opening.

In practice, the knitwear items 1 of FIG. 3, for instance a bra-vest, is provided with the weld 2A attached only on the central part Y, but detached or separated, therefore laterally open with the creation of two loops automatically produced, which, bent upwards along the arrows F and F1, take on the shape and function of shoulder straps SS-SD.

FIG. 2 shows an enlargement of section 6 of FIG. 1: 2A is the initial double elastic welt; 5A is the opening produced; 8 and 9 the fabric strips adjacent to said opening, also provided with double-layer welts DB.

Among the main aims of the present invention there is also the manufacture of various opening and/or separations of partial knitted courses by suitably using a special soluble yarn FS, which completely melts at high temperatures.

Said yarn FS is fed to the needles with an additional yarn feeder in selective and limited way, alternatively to the usual yarn. Said embodiment is also shown in FIG. 2: the fabric area 5A formed by one or more courses is produced only with the soluble yarn FS, preferably surrounded by knitted courses produced with the usual yarn and the thermo-adhesive yarn FTA ensuring a better non-run feature.

In this specific case there is no interruption of the fabric-building process carried out by a part of the cylinder needles according to defined fabric zones or areas.

The controlled separation of at least two knitted courses, both preferably attached to at least a central common knitted course, is obtained by means of the dissolution of said last common knitted course in the following hot stage of color fastening or dyeing. A more complex embodiment of the described method is shown in FIG. 4: the knitted tube 1 is characterized by a knitted structure in diapered jersey on the lower part MI, and on the upper part by a open-work knitted structure T.

On the middle line there is an elastic welt BE, whereas the usual double welts DB on the ends are partially separated along the lines A and lifted according to the arrows F1. Said open-work knitted structure is made up of suitably placed openings or holes produced by discharging some stitches from the corresponding needles and resuming the fabric-building process after the forced opening of the needle latches.

By way of alternative, similar open-work effects can be obtained by suitably using only the heat-soluble yarn FS, only partially fed to the needles and therefore subject to dissolution. FIG. 5 shows the final manufactured item 1, constituted by two concentric knitted tubes (part MI is introduced into part MS along arrow F) and provided with separate shoulder straps SS-SD and lower elastic welt BE, beyond being also characterized by interesting aesthetic effects due to various overlapped knitted structures.

The separation of the knitted courses obtained both by means of the programmed loop discharge and by using the above-mentioned soluble yarn FS involves several advantages, enabling among other things to re-design in anew and original way some of the manufactured items. In particular, the knitted tube 1 in FIG. 13 is provided with the usual double welts 2–2*a*, possibly modified with edges and profiles DBO of the lacelike type, FIG. 14, and/or picot or mouse-tooth, a wording known to the person skilled in the art.

In FIG. 14 the knitted tube is further characterized by a plurality of inner frills Bi and by a knitted area 3 which is wider than usual by means of the suitable excursion of the motorized knitting cams, said cams being controlled by the computer of the textile machine.

In FIG. 15 the separation of knitted half-courses, which is the object of the present invention, occurs after the production of the half-double welt 11 and before the beginning of the second half-double welt 12, which form together the complete welt DBE.

FIG. 16 schematically shows various production modes for the above-mentioned double welds: on the one hand the half-welt DB is obtained by means of half the dial jacks and the needles of the cylinder half below; on the other hand the half-welt DB1 is produced without any jack but only with the alternated needles, for instance the odd ones, thus producing a double two-layer half-welt DB1 lifted along arrow F.

It should be observed that the production of the half-welds is affected by contingent factors and by the fact that there are adequate differences of textile elasticity between the half-welts thus obtained.

Finally, the manufactured item 1 is completed by the lower part MO, substantially produced by structures of diapered fabric, narrower with respect to the central area 4, a sort of dome-like structure with very loose fabric which is more suitable to the men's anatomy.

The pair of pants 1 in FIG. 17 is further characterized by fabric areas having a different elasticity for purposes of containment or inguinal or ventral anatomic support in the concerned case. As a matter of fact, the rectangular zone 15, widely variable, is characterized by knitted structures of embossed fabric and/or with tuck stitches PT, even multiple, suitably placed and preferably manufactured with a more resistant yarn.

The area 13 below, substantially triangular, is characterized by a plurality of frills Bi, suitably located as vertical and/or diagonal ribs. The knitwear item 1 shown in FIG. 18 is further characterized in that the two double half-welts DB are intentionally open on their ends as a consequence of the reduced number of dial jacks and needles to this purpose, or produced with open frills Bi. This embodiment ensures the subsequent introduction of a belt or string K having aesthetical or functional purposes together with the economic advantage represented by the replacement, if necessary, of the expensive elastomeric yarn with a much cheaper traditional yarn. In this embodiment as well the inguinal and/or ventral area between the hatched lines 14 and 14' is characterized by a plurality of frills Bi suitably placed with functions of anatomic support or containment, improved even more by suitably using an elastomeric yarn, also different as far as count and/or compression are concerned from the yarn generally used for the elastic welt and/or in other parts of the manufactured item.

Other embodiments within the framework of the present invention are represented by the manufactured items 1 variously shown in FIGS. 19 to 24, further characterized by the presence of a fabric strip similar to a wide strap or loop 3A, located within the manufactured item. The initial knitted tube 1 of FIG. 19 shows an area 3 with wider stitches with respect to the adjacent areas.

Figure 20:
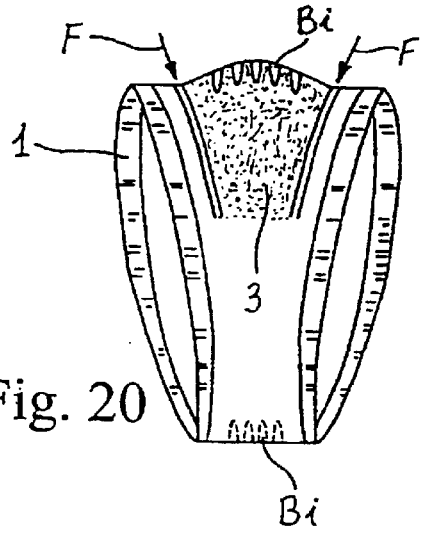
FIGS. 20 and 21 show a pair of pants obtained from the knitted tube of FIG. 19 and having a fabric strip or loop 3A preferably inserted therein.

In FIG. 20 said knitted tube 1 is completed by means of some inner knitted frills Bi, placed one opposite the other and with the partial and suitable separation of knitted half-courses, according to the invention, on the arrows F.

Figure 21:
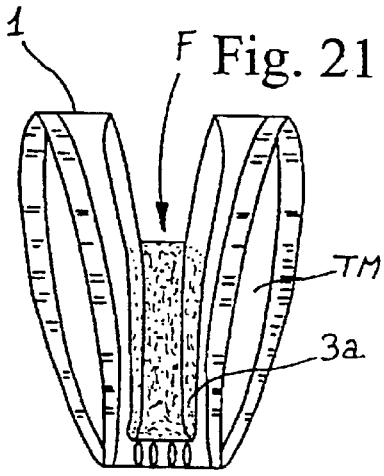

The fabric strip or wide loop thus obtained, generally indicated with 3A, falls into the knitted tube TM, FIG. 21.

Figure 22:
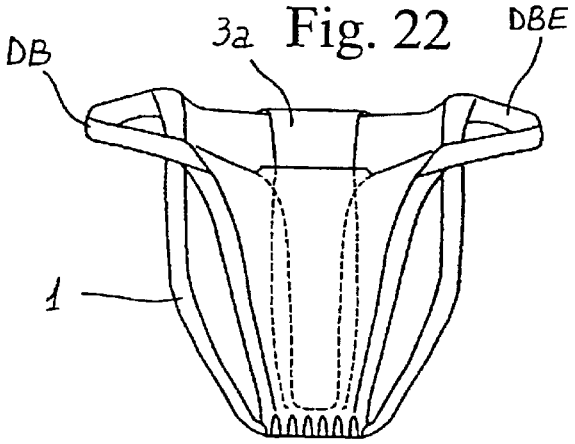
FIGS. 22 to 24 show different embodiments of pants with loops 3A.
Figure 23:
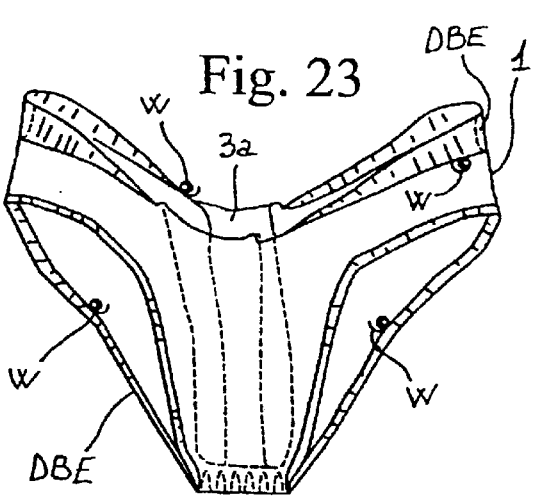
Figure 24:
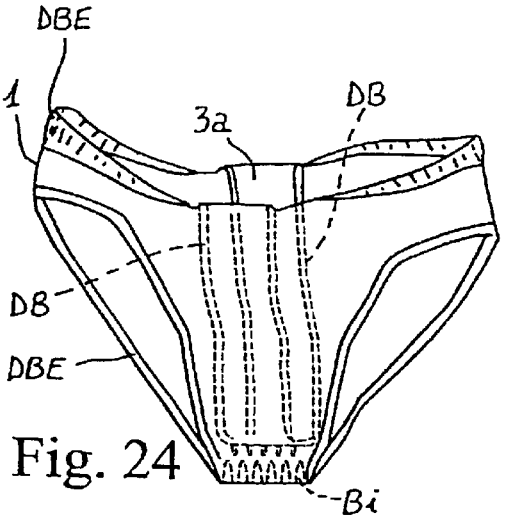

In FIGS. 22–23–24 the pair of pants 1 takes on its final shape, substantially characterized by the presence and function of the aforesaid loop 3A, beyond some differences regarding the shape of the welts DB and DBE. The general comfort of the manufactured item improves thanks both to the presence of the aforesaid loop 3A, also provided with two-layer welts DB in FIG. 24, and to the presence of opposite inner frills Bi. Moreover, the possible wastes W, even very thick, on the manufactured items 1 of FIGS. 16 and 23, are intentionally lengthened so as to increase comfort. More in general, the loops 3A represent for people skilled in the art wide possible embodiments per se, such as indifferently introduced or worn inside the manufactured items in general, among which the stocking in FIG. 43, or outside said manufactured items.

The programmed repetition of the interruption and/or the resumption of the fabric-building process according to the present invention produce within the knitted tube under working various openings (such as 4 in FIGS. 37–38, or 5 in FIGS. 34–35, or 6 in FIG. 45), which can be equipped with single or double welds DB.

Among the main aims of the present invention there is also the production of tubular manufactured items preferably having the two ends of the knitted tube closed, totally or partially, with at least an opening provided with welts.

Said result is carried out thanks to the procedures schematically shown in FIGS. 25–27–29.

FIG. 25 shows the usual rotary needle cylinder C integral with the dial P above, provided with jacks U. During the making of the so-called double weld, a wording known to the person skilled in the art, the knitted tube M is simultaneously attached both to the needles A of the cylinder C and to the jacks of the dial P.

According to the invention, one of the needle beds, preferably the dial P, slows down or preferably loses up to 360° of rotation with respect to cylinder C, so that the knitted tube M undergoes a central torsion along arrow F, strengthened by the subsequent transfer of the jacks to the cylinder needles.

Considering possible variations, said procedure enables the easy and gradual control of the final diameter of the knitted tube until the complete closing or narrowing characterized by a two-layer fabric with a central spiral-like rosette RCS similar to a diaphragm.

To this purpose the invention provides for an additional variant of the method described above: after the knitted tube M has undergone the central torsion along arrow F, and before the jacks are transferred to the cylinder needles, one or more yarns, also elastic yarns, suitably excluded from the fabric-building process, wrap the knitted tube so as to define and mark the diameter of the central rosette RCS, or the neck portion-double welt GC-DB of FIG. 33, which can be further padded for a higher comfort.

FIG. 26 shows a section of the knitted tube 1 closed by means of the central two-layer spiral-like rosette RCS. The method shown in FIGS. 27 and 29 is different from the previous one in FIG. 25, among other things, because there are no shifts between the cylinder C and the dial P, always rotating integrally. In this embodiment as well, during the building of the so-called initial double-welt, the knitted tube M is simultaneously attached both to the needles A of the cylinder C and to the jacks U of the dial.

The knitted tube M undergoes a gradual narrowing or central narrowing similar to an hourglass, caused by one or more yarns suitably excluded or not working and gradually kept back or withdrawn in the direction of the arrows F, repeatedly coiled until the total or partial closing of the fabric, strengthened by the subsequent transfer of the jacks to the cylinder needles. Said central rosette, more regular from the textile point of view, always shows a minimum, though variable hole, so that it is always "open" by default (RCA, section view in FIGS. 28 and 30).

In general, the total closing or partial narrowing of the knitted tube cause interesting results as far as versatility and wearability of the manufactured items according to the present invention.

Considering technical-textile factors regarding the diameter and the gauge of the knitwear or hosiery machine used to that purpose, together with the accurate choice of knitted structures and/or suitable yarns, the variable opening and/or closing of the central rosette, RCS and/or RCA, enables the size programming with interesting practical applications regarding some details of the manufactured items concerned, such as the above-mentioned neck portion GC, the inguinal portion or crotch RC, the stocking of FIGS. 43–46, and others.

It should eventually be pointed out that the central rosettes which are described, possibly padded according to the present invention, are particularly innovative and represent a substantial technical, aesthetic and functional improvement.

Among the immediate advantages which can be observed we can mention the virtual elimination of cutting/sewing operations, the reduction of production costs together with the higher comfort and general wearability of the manufactured item, substantially free of seams or provided with suitable or local pads. As a matter of fact, the described central rosettes, normally two-layered, can be padded inside by introducing additional floating yarns FF, or knitted yarns FT, FIG. 28, variously-fed or attached between the two layers during the building of the double weld and before its final closing.

As an alterative, the inner pad is obtained by means of terry like three-dimensional fabric or with the same production method as the above-mentioned frills Bi, variously repeated, preferably placed within the two layers.

The total closing of at least one end of the knitted tube, together with the separation of knitted courses obtained both by means of the programmed discharge of needles and by suitably using the above-mentioned soluble yarn FS, involves several advantages and enables, among other things the re-design in a new and original way of some tubular manufactured items.

An example is schematically shown in FIGS. 31 and 31*a*: on the knitted tube 1 (or 1*a* in plan view), provided with the elastic welt DBE on its upper end and closed with a central rosette RC below, two symmetrical openings are automatically created in the direction of the knitted courses along arrows F.

The result is shown in FIG. 32: an almost complete pair of pants 1, with double elastic welt DBE, the lateral openings for legs L-L1 with possible double welts DB, also elastic, and the central rosette acting as crotch RC, also partially open.

FIG. 33 shows a section view of a practical application regarding the neck portion indicated with GC-DB also in FIG. 35: said portion is obtained by means of the method involving the production of the initial (or final) double weld DB with an at least relatively elastic yarn.

Said portion can easily be adjusted in width so as to create a collar or neck portion proportioned to the diameter of the needle cylinder and variously usable within the framework of the present invention, for instance said GC-DB in FIG. 35.

The additional introduction between the two layers of a preferably elastic yarn before the final transfer of the dial's jacks to the cylinder's needles creates a collar or neck portion such as GC-RC indicated in FIG. 36. The broad flexibility of the invention allows to obtain a series of new, original and practically finished knitwear items, variously characterized by shoulder straps, loops, straps and/or openings for feet, arms and legs automatically produced so as to substantially modify also the shape and functions of at least a part of the present knitwear and hosiery production.

Other practical embodiments of knitwear items produced according to the invention are shown in the figures numbered 34 to 39.

In FIG. 34 the numeral 1 indicates a bra with a lower elastic band DBE, upper shoulder straps SD-SS and double welts DB. The numeral 1' indicates a pair of pants having an upper elastic band, preferably made up of two symmetrical half-welts DBE, an opening 5 provided with double welts DB and the central rosette RCA on the crotch, also relatively open for a better hygiene, ventilation and comfort, and horizontal openings for the legs 7.

In FIG. 35 the manufactured item 1 is a single piece similar to a teddy or swimsuit, provided with a neck portion GC-DB produced with the double-welt method, with openings for arms having double welds DB, with optional tubular sleeves MT, equipped with at least a welt, also elastic, for the wrist and a single welt on the shoulder.

Said manufactured item 1 is characterized by structures of diapered fabric MO creating a suitable anatomic shape and/or enabling a support of the breast, beyond the two areas of enlarged fabric MA, divided by a series of inner frills Bi suitably placed. The lateral opening 5 is produced by means of the partial separation of knitted courses and can indifferently have single or double welds DB.

The lateral opening 6 is preferably obtained during the production by using moving or fixed cutting means or elements, such as rotary blades, scissors, electrical resistances and the like, considering contingent technical-textile factors.

Similar cutting means are currently used in machines for the assembly of tights. In this specific case said means are placed within the needle cylinder, controlled by suitable moving cams which can be actuated, or along the track or path of the manufactured item, together with a more suitable tensioning of said item.

As far as manufactured items such as female hosiery are concerned, usually produced with very thin nylon yarn, 12 to 75 dtex, it is preferable to use an electrical resistance or a similar hot-cutting element which melts said yarn.

For other working procedures characterized by low gauges and robust yarns, the use of usual tensioning means for the fabric or manufactured items being worked. 30 (A longitudinal cut LT similar to the one described and shown in FIGS. 31, 31*a* and 41).

Also in the manufactured item of FIG. 35, therefore, the lower end on the crotch is closed by a central rosette RCI, also padded for a higher comfort. In FIG. 36 the manufactured item is provided on its upper part with front and back shoulder straps SA and SP together with the neck portion GC-RC obtained with the described method including the highly opened central rosette.

The lower part on the crotch is a closed central rosette RC. This manufactured item is further characterized by the presence of the two-layer miniskirt MG, automatically machine-produced on the middle line or on the waist. In practice, it is a double-weld fabric DB with the desired length and produced in sequence along arrows F.

By starting production of the present manufactured item from the lower end, i.e. from the central rosette RC, the fabric-building process relying on the needles only is unchanged until the waist. From there on the miniskirt MG, preferably a two-layer one, is obtained by means of the traditional method of the double welt, i.e. by temporarily transferring the knitted tube onto the dial jacks and continuing production for a high number of courses until the final transfer of the jacks to the needles.

Incidentally, the so-called double welt in a suitable jersey machine can also be obtained with other methods than the described one, regarding the dial jacks; for instance only with alternated needles or thanks to special sinkers.

The embodiments shown in FIGS. 41 to 46 relate to hosiery items characterized by the presence of at least two central rosettes RC carried out according to the invention and located on the foot toe and heel, together with the presence of at least a horizontal opening or vertical slot obtained according to the described methods.

Said closing can be indifferently obtained both by means of the production method described, concerning two-layer central rosettes, and by means of other known closing methods for stocking toes.

The suitable use of alternated motion within the framework of the invention is known to slow down production, though in some cases it improves the general quality of the manufactured items, allowing among other things to emphasize inside and/or outside edges, welts and half-welts located in various places, beyond giving a greater precision as far as the anatomic shape of certain details is concerned. In FIG. 40 the knitted tube 1 is provided with a first central two-layer rosette RC and of a second central padded rosette RCI.

There are also areas with tight fabric ZMS and areas with enlarged fabric ZMA, beyond a plurality of inner frills Bi variously located for a higher comfort.

In FIG. 41 the knitted tube 1 is provided with at least a horizontal opening 10 defined by the symmetrical half-welts DB, adjacent to areas with non-run fabric ZI, into which the foot can be introduced.

As an alternative to said opening 10 a cut is provided along line LT, by means of which a longitudinal opening having single welts BS is obtained.

The upper end, already closed by means of the central rosette RC in FIG. 40, is now replaced by a common toe, automatically closed with the machine PCA, with its corresponding sewing line S.

FIG. 42 is a section view of the stocking 1 with its ends closed by two central rosettes RC and provided with inner frills Bi variously located.

The necessary opening for the foot is defined on one hand by a single half-welt BS, whereas on the other hand a double welt DBA can observed, said welt being thicker and preferably produced with the alternated motion of the cylinder for an additional more regular and more gradual fabric growth.

The stocking 1 of FIG. 43 is characterized in particular by the presence of the central loop 3A, placed between the two symmetrical double half-welts DB.

Said central loop is produced automatically according to the invention and it is usually meant to be inserted, preferably though not exclusively, into the manufactured item.

FIGS. 44–45–46 show some variants of the stocking concerned.

In FIG. 44 the stocking 1 is further characterized by the part corresponding to the instep, rather high, having two half-welts DBA produced with the method including the alternated motion of the cylinder. In FIG. 45 the stocking 1 is provided, beyond the two central rosettes RC1 and RC2, with various double welts, DB to DB3, alternating from the knitted area 4 and from the opening 6.

Finally, FIG. 46 shows the stocking 1 with a very low double welt DB.

The end on the toe is closed with the method of the central rosette RC, whereas the other end on the heel, PCA, is closed with the usual method used for the toe, carried out automatically with the machine.

The present description, though being limited for obvious reasons, gives the person skilled in the art an overview on several possible innovations within the framework of the present invention.

Constructive details can vary in equivalent fashion in the form, dimensions and/or position, as well as in the nature of the technical materials and/or fabrics in use, without thereby departing from the scope of the present invention.

What is claimed is:

1. Method for manufacturing three-dimensional knitwear and hosiery items (1), in knitting machines provided with at least a needle-bed or cylinder (C), comprising the step of:

producing a first length of tubular knitted fabric (M) having a cylindrical shape and ending with a last stitch course, the needles (A) of the needle-bed (C) being fed with a first yarn;

wherein it comprises the steps of:

feeding a predetermined number of said needles (A) of the needle-bed (C), corresponding to specific fabric zones or areas, with a second heat-soluble yarn (FS) instead of said first yarn;

producing a second length of tubular fabric (M) comprising at least a portion of soluble fabric produced by said predetermined number of needles (A) of the needle-bed (C) with said second heat-soluble yarn (FS), said second length of tubular fabric starting with a first stitch course; and dissolving said portion of soluble fabric in a heating phase thus obtaining a controlled separation of at least two knitted courses attached to said portion of soluble fabric.

2. Method according to claim 1 wherein it further comprises, before the step of dissolving said portion of soluble fabric, the steps of:

feeding said predetermined number of needles (A) of the needle-bed (C) with said first yarn instead of said second heat soluble yarn (FS); and producing at least a third length of tubular knitted fabric (M), thus obtaining a controlled opening in the tubular fabric (M) in said step of dissolving said portion of soluble fabric.

3. Method according to claim 1 wherein said items are automatically produced with the continuous motion of the needle cylinder (C) without any interruption of the fabric building process carried out by the cylinder needles (A).

4. Method according to claim 2 wherein it produces, in the item (1), at least two elongate openings forming a loop (3A) which can be inserted into the manufactured item (1).

5. Method according to claim 4, wherein said loop (3A) is produced, instead of using a soluble yarn (FS), by a programmed interruption of the fabric-building process carried out by at least a part of the cylinder needles (A), according to specific fabric zones or areas, followed by the automatic and programmed resumption of the fabric-building process preferably carried out by the same needles (A), specific fabric zones and areas, produces the controlled separation, according to programmed zones, of theoretically subsequent knitted courses, one course representing the last knitted course of the already produced fabric (M), whereas the other one represents the first knitted course produced after the aforesaid interruption.

6. Method according to claim 1 for manufacturing knitwear items with open-work jacquard fabric (T) consisting in suitably located openings or holes.

7. Method according to claim 6 wherein said open-work fabric (T) is produced, instead of using a soluble yarn (FS), by discharging some stitches from the corresponding needles (A) and resuming the fabric-building process after opening by force the needle latches.

8. Method for manufacturing three-dimensional knitwear and hosiery items, in knitting machines provided with at least two rotating needle-beds, a dial (P) having jacks (U) and a cylinder (C) having needles (A), comprising the step of:

producing a first length of tubular knitted fabric (M) having a cylindrical shape, said knitted fabric (M) being simultaneously attached to the needles (A) and to the jacks (U);

wherein it comprises the step of:

producing a second length of tubular fabric (M) by automatically and progressively reducing the diameter of the tube (M) during the knitting process of the same.

9. Method according to claim 8 wherein it further comprises, after the step of producing a second length of tubular fabric (M), the step of transferring the fabric (M) from the jacks (U) of the dial (P) to the cylinder needles (A).

10. Method according to claim 8 wherein said reduction is obtained by twisting the tubular fabric (M) during the knitting process.

11. Method according to claim 10 wherein said step of producing a second length of tubular fabric is carried out by displacing the rotation of said dial (P) with respect to the rotation of said cylinder (C) for a predetermined time interval, thus obtaining a central torsion of the knitted tube (M) and a progressive reduction in diameter of the same.

12. Method according to claim 11 wherein said displacement is obtained by slowing down the rotation of said dial (P) with respect to the rotation of said cylinder (C) for a predetermined time interval.

13. Method according to claim 12 wherein during said step of producing a second length of tubular fabric (M), said dial (P) delays up to 360° rotation with respect to the cylinder (C).

14. Method according to claim 8 wherein said reduction is obtained by a gradual narrowing, substantially similar to a sandglass, of the tubular fabric (M) during the knitting process, said gradual narrowing being obtained by excluding one or more yarns from the knitting process and gradually keeping back or withdrawing said yarns in a direction perpendicular to the knitted tube (M), said yarns being repeatedly coiled at least until a partial closing of the tubular fabric (M).

15. Method according to claim 8 wherein said step of producing a second length of tubular fabric further comprises the step of strengthening the reduction of diameter of said knitted tube (M) by wrapping one or more yarns around the knitted tube (M) after the reduction of the same and before a subsequent transfer of the fabric (M) from the jacks (U) of the dial (P) to the cylinder needles (A).

16. Method according to claim 8 wherein said tubular fabric (M) is at least partially closed on both ends by reducing the diameter of the tubular knitted fabric (M) also before the step of producing said first length of tubular knitted fabric (M).

17. Method according to claim 8, wherein in said step of producing a second length of tubular fabric (M) at least an end of said tubular knitted fabric (M) is substantially totally closed.

18. Method according to claim 8, wherein said items (1) are also shaped and provided, also alternatively, with at least:

a shoulder strap or loop; and/or a neck portion; and/or a horizontal or vertical opening; and/or an automatically closed end; and/or having single or double welts; said items being manufactured automatically, preferably with the continuous motion of the needle cylinder (C).

19. Method according to claim 16 wherein said ends, preferably two-layer or two-fabric ends, are also padded by introducing yarn or by producing additional stitches, even three-dimensional stitches.

20. Knitwear item as obtainable by the process of claim 1 comprising a knitted tube (M) automatically closed on both ends and having at least one opening provided with edges or welts.

21. Knitwear hosiery item as obtainable by the process of claim 16 comprising both ends, closed even only partially, are preferably located on the foot heel and toe.

22. Knitwear item as obtainable by the process of claim 1 wherein it contains at least a longitudinal opening in the fabric in the direction of the ribs.

23. Knitwear item as obtainable by the process of claim 1 wherein it comprises shoulder straps or loops, which can be provided with additional sleeves, preferably tubular, successively sewn without appreciable fabric scraps.

24. Knitwear item according to claim 23 wherein it said additional sleeves are provided with a double welt (DB), also elastic, for the cuff, and a double welt (DB), preferably without elastic, on the shoulder.

25. Knitwear item as obtainable by the process of claim 1 comprising fabric areas with a different elasticity, produced with one or more elastomeric yams, substantially different as far as count and elastic force are concerned.

26. Knitwear item as obtainable by the process of claim 1 comprising at least one loop (3A) for various uses.

27. Knitwear item as obtainable by the process of claim 1 characterized by at least one shaped end with function of hat or hood.

28. Knitwear item as obtainable by the process of claim 1 comprising a knitted tube partially folded inside and forming two concentric layers with shoulder straps.

29. Knitwear item as obtainable by the process of claim 1 comprising two openings for the legs, provided with an elastic welt (BE), also an edged welt, with at least a horizontal opening provided with two half-welts (11,12), wastes (W) also lengthened, and a plurality of inner frills (Bi) variously located.

30. Knitwear item according to claim 29 comprising an additional string or belt (K).

31. Knitwear item according to claim 30 comprising a zone of ventral support (14,14').

32. Knitwear item according to claim 30 comprising zones (13,15) for inguinal and ventral support.

33. Knitwear item as obtainable by the process of claim 1 comprising a central loop (3A), having double welts (DB) with inner frills (Bi), inserted into the manufactured item (1).

34. Knitwear item as obtainable by the process of claim 1 comprising:

an end located on the crotch and automatically closed; two lateral openings for the legs, automatically produced and preferably provided also with edges or welts; a suitable number of knitted courses ending with a double welt (DB), also an elastic double welt (DBE).

35. Knitwear item as obtainable by the process of claim 1 wherein the production cycle indifferently starts from the elastic welt (DB) or lower end.

36. Circular knitting machine for manufacturing tubular knitwear items in general, including at least:a needle bed or rotary cylinder (C) versus fixed cams or vice versa; a complete working feed provided with: cams for fabric-building which can be individually adjusted by means of step-by-step motors and computers so as to pre-establish or stress anatomical shapes; one or more yarn feeders; at least one additional yarn feeder for feeding only a part of the needles (A) with a heat-soluble yarn (FS); preferably electronic needle selection for controlling the elements involved in the fabric-building process according to a design/work cycle or program; a latch-opening device (AL); another needle bed or dial (P) provided with needles or jacks (U) with butts, spaced and suitably arranged and then selected thanks to suitable cams; said dial (P) having the function to shift directly or indirectly its position until 360° with respect to the needle cylinder (C); a fabric suction or drawing system also working with one or more means fur cutting or partially separating fabric areas, means for longitudinally cutting the manufactured items (1), and electrical means for cutting or melting the soluble yarns (FS) of the manufactured items (1).

* * * * *